US005141411A

United States Patent [19]

Klaeger

[11] Patent Number: 5,141,411

[45] Date of Patent: Aug. 25, 1992

[54] CENTER-ANCHORED, ROD ACTUATED PUMP

[76] Inventor: Joseph H. Klaeger, P.O. Drawer 445, Hondo, Tex. 78861

[21] Appl. No.: 621,363

[22] Filed: Nov. 30, 1990

Related U.S. Application Data

[63] Continuation-in-part of Ser. No. 518,166, May 3, 1990, abandoned.

[51] Int. Cl.[5] ..... F04B 7/00

[52] U.S. Cl. ..... 417/445; 417/444; 417/450; 417/430

[58] Field of Search ..... 417/444, 445, 450, 430, 417/552

[56] References Cited

U.S. PATENT DOCUMENTS

| | | | |
|---|---|---|---|
| 1,665,967 | 4/1928 | LeBus | 417/445 |
| 1,900,588 | 3/1933 | Scott | 417/450 |
| 3,055,764 | 9/1962 | Pryor et al. | 417/444 |
| 3,510,234 | 5/1970 | Wolf | 417/450 |
| 3,822,970 | 7/1974 | Smith et al. | 417/552 |

*Primary Examiner*—Richard A. Bertsch
*Assistant Examiner*—Charles G. Freay
*Attorney, Agent, or Firm*—Vaden, Eickenroht, Thompson, Boulware & Feather

[57] ABSTRACT

A fluid pump which is particularly useful in relatively deep and/or low pressure stripper wells. Stripper wells tend to produce sporadically and/or occasionally produce gas, and are often very sandy, have a tendency to become gas locked, and are susceptible to sticking and sanding. Fluid is displaced out of the pump into the production tubing through exit ports located immediately above the hold-down, e.g., at a point intermediate the ends of the barrel of the pump. The pump includes a traveling valve and a standing valve, the traveling valve being provided with a valve member which includes a downwardly extending stem which terminates in a lower bearing surface, and the standing valve being provided with a valve member having an upper bearing surface. As the plunger of the pump is reciprocated, the lower bearing surface of the valve member of the traveling valve mounted therein contacts the upper bearing surface of the valve member of the standing valve when the plunger is near the maximum extent of downward travel to force the traveling valve open and/or force the standing valve closed depending upon fluid pressure conditions and whether the standing valve is stuck open. Likewise, the pump avoids the sticking and sanding problems caused by such wells by routing fluid through the annulus between plunger and barrel and out the exit ports to flush particulate matter with each stroke of the plunger.

5 Claims, 2 Drawing Sheets

CENTER-ANCHORED, ROD ACTUATED PUMP

CROSS REFERENCE TO RELATED APPLICATION

This application is a continuation-in-part of my copending application Ser. No. 07/518,166, filed on May 3, 1990, now abandoned entitled "Rod Actuated Pump and Method".

BACKGROUND OF THE INVENTION

The present invention relates to pumps having suction and discharge valves such as fluid production pumps of the type often referred to as a bottom hole pump. In more detail, the present invention relates to a centered-anchored, rod actuated downhole pump which is particularly useful for production from shallow oil wells of the type known as stripper wells because of its immunity to the sanding, gas lock, and other problems which typically characterize the bottom hole pumps which are commonly used for oil and gas production.

Although reference will be made throughout this specification of the use of a pump constructed in accordance with the present invention in an oil well, and particularly in a stripper well, it is not intended that the application of the present invention be so restricted. Many surface pumps having suction and discharge valves used for, for instance, fluid production or the pumping of mud or cement, are prone to the same problems of gas lock and/or the sticking of the valve(s) in an open position as a result of the lodging of particulate matter in that valve as are downhole pumps. The following description of a center-anchored, rod actuated, submerged pump constructed in accordance with the present invention is, therefore, considered an exemplary application of the apparatus of the present invention described for the purposes of complying with the disclosure requirements of the Patent Statute, it being understood that the scope of the invention is not so restricted.

Gas lock occurs in virtually all wells, but is especially common in stripper wells, e.g., those wells which are approximately 1000 feet or less in depth. In such wells, the fluid weight in the production tubing may be, for instance, about 400 p.s.i. against the traveling valve of the downhole pump as the piston is on the upstroke lifting fluid to the surface. That 400 p.s.i. remains against the traveling valve as the piston reverses directions. During the upstroke, fluid (oil and gas) enters the barrel of the pump as a result of the relief of pressure against the standing valve such that the standing valve opens to allow fluid to enter the barrel. The fluid in the barrel is compressed by that 400 p.s.i. on the downstroke until the pressure in the barrel causes the traveling valve to open to allow fluid to enter the production tubing and stay open until the piston reaches the bottom of the stroke and reverses. Upon reversal, the traveling valve closes, trapping fluid in the production tubing.

As long as there is sufficient fluid in the barrel of the pump, the commercially available pumps known to Applicant work very well, but when the well pumps off and only a small amount of fluid enters the barrel through the standing valve during the upstroke, or when a small amount of fluid and a large quantity of gas enter the barrel, the pressure that accumulates on the downstroke, for instance, 380 p.s.i., does not exceed the 400 p.s.i. needed to open the traveling valve. When the piston reverses, the 380 p.s.i. trapped between valves expands, keeping the standing valve closed, until the pressure in the barrel is lower than the pressure in the well. If the well is pumped off, there is no fluid in the casing and the standing valve stays closed, no fluid enters the barrel during the up-stroke, and the 380 p.s.i. is simply "re-compressed" on the downstroke. A pump in this condition is said to be "gas locked". The pump remains gas locked until either the fluid pressure in the casing rises to a level high enough to overcome the pressure in the barrel or something is done on the surface to unlock the pump.

Other problems are common to such pumps. For instance, both standing and traveling valves often stick in the open position. The sticking of the valves is a result of their ball and cage construction, which makes them susceptible to the lodging of particulate matter between the ball and the valve seat. It is not uncommon for the pump itself to stick and/or the barrel as a result of sand and other particulate matter becoming caught between the barrel and the plunger, the tolerances of which are close so as to effect a seal between plunger and barrel, and if sand lodges therebetween, either the plunger or barrel will be cut or the plunger sticks in the barrel. The structure of such pumps makes them particularly prone to such damage because such pumps rely on a seal which is formed between plunger and barrel by the leading edge of the plunger. Of course it is on the downstroke when the most pressure is exerted on that seal, and the location of that seal on the leading edge of the plunger causes the fluid, and the particulate matter suspended therein, to tend to be forced into the space between barrel and plunger as a result of that pressure. Further, the requirement of precise tolerances between plunger and barrel increases the cost of manufacturing such pumps and makes them difficult to refurbish and maintain.

Another common problem, referred to as "fluid pound", is a distinct, non-metallic jarring felt in the pull rod part way down the stroke. This problem results from partial filling of the barrel of the pump during the upstroke of the plunger. When partially filled, the fluid in the tubing will follow the traveling valve down and, when the traveling portion of the pump does contact the fluid, it momentarily all but stops its motion, and the momentum of the entire column of fluid in the tubing aids in keeping the traveling valve momentarily closed. Stopping this fluid suddenly develops severe hydraulic shock, similar in character to the "water hammer" that occurs if a plug valve suddenly cuts off the flow of water in a long line. The effect of this shock is transmitted through the traveling assembly of the pump, causing a severe shock wave in the portion of the pump between the standing and traveling valves. This shock wave can attain forces several times that of the static pressure in the tubing column, and when it occurs near the middle of the stroke, the plunger is reaching its maximum velocity and the magnitude of the pound is most severe. Naturally, the pressure increase of this shock wave opens the traveling valve and the force of the shock is immediately dissipated in the larger volume of fluid in the tubing.

Fluid pound is naturally more severe in deep wells because of the higher pressure and longer column of fluid that is in motion, or in larger bore pumps where the mass of fluid in motion is larger, but affects pumps usable in wells of any depth. Although pumps are surprisingly rugged, the cumulative fatigue effects of fluid pound in the pump barrel, the rod string, and the pumping unit cannot be ignored. The barrel of a top anchored pump has the poorest resistance to fluid pound since the shock pressure generated in the lower portion of the barrel has only the relatively low pressure of the fluid in the well bore at suction pressure acting on the outside of the barrel. Severe fluid pound should, therefore, be specifically avoided in top anchored pumps.

Even this short description of some of the problems which are common to conventional downhole pumps highlights the difficulties encountered when the pump is used in stripper wells. Such wells are often sporadic or slow producers of oil, and are therefore prone to being pumped off, and often produce varying quantities of oil and/or gas such that gas lock is a particularly common problem. The fluids produced by such wells often include large quantities of sand and other particulates which can foul the pump. Further, even though they are generally shallow, various pressure conditions and depths are encountered in different stripper wells such that the choice of pump for a particular stripper well often is a choice between pumps having the fewest disadvantages. There is, therefore, a need for a downhole pump which overcomes these tendencies for use in such wells and it is a principal object of the present invention to provide such a pump.

The choice of rod actuated pump for use in a stripper well is generally a choice made between three types of pump:

Stationary barrel top anchor pump

This pump has the hold-down at the top of the barrel, so the entire barrel and standing valve of the pump extend below the shoe.

Stationary barrel bottom anchor pump

This pump has the hold-down at the bottom. The standing valve and entire pump are above the hold-down inside the production tubing.

Traveling barrel bottom anchor pump

This pump has the hold-down on the bottom of a section of hollow pull tube below the plunger. The standing valve is at the top of the plunger. The entire pump is above the hold-down and remains inside the production tubing.

However, each of these types of pump has its limitations, well recognized in the industry, relating to the above-summarized problems. For instance, it is hazardous to run a stationary barrel, bottom anchor pump in a sandy well because sand can settle tightly in the annulus between the barrel of the pump and the production tubing, causing it to stick tightly in the joint. Also, when such pumps are operated intermittently, as is often the case in a stripper well, they allow sand and other particulate material to settle past the barrel rod guide and on top of the plunger while the pump is not operating, thus creating the possibility of sticking the pump when production is commenced.

Traveling barrel, bottom anchor pumps are recommended for use in this latter application, but are at a disadvantage in wells with the low static fluid levels that are often found in stripper wells. To get into the pumping chamber, the fluid must rise through the pull tube and plunger and past the standing valve. Since the standing valve is located in the plunger top cage on a traveling barrel pump, it is necessarily small in diameter and therefore offers more fluid in the blind cage of a stationary barrel pump. Further, even at the relatively shallow depth of most stripper wells, the deeper the well, the more one tries to avoid running longer lengths of traveling barrel pumps in the well. When the standing valve (in the plunger top cage) is closed, a column load is transmitted by the plunger through the pull tube and hold down into the shoe. The deeper the well, the more likely this load will be sufficient to put a bow in the pull tube, thus setting up a drag between the barrel and the pull tube. Also, traveling barrel pumps are not generally run in slant holes, or wells that might be crooked at the shoe. Either condition will cause excessive wear on the pump barrel, and will detract from the travel and therefore the displacement of the pump. Perhaps most importantly in stripper wells, if spaced too high, sand or other particulates can settle around the pull tube as high as the lowest point reached on the downstroke.

In some sandy wells, a stationary barrel, top anchor pump is recommended to avoid sanding in of the pump. The amount of sand that can settle over the seating ring or top cup of such pumps is limited to a maximum of about three inches because fluid discharge from the guide cage washes it free above that point. However, such pumps are susceptible to fluid pound and are generally better suited for wells of shallower depths.

Various attempts have been made to provide pumps and/or accessories for pumps to solve these problems in the past. For instance, a so called "Sandy Fluid Pump" is available from USS Oil Well which is advertised as having "a very tight clearance . . . between barrel assembly liner and plunger" and "a sharp edge . . . at the liner entrance lip to act as a wiper to help exclude sand and scale from" between barrel liner and plunger. Further, the oversized top plunger cage of that pump is said to create "a surging turbulence in the chamber above the liner lip to prevent sand from settling in this area . . . ". Likewise, a bottom discharge valve is available for use in connection with the downhole pumps available from National Rod Pumping under the brand name "Oilmaster" which is said to "prevent sand from settling around a stationery barrel by discharging a portion of produced fluid at the bottom of the pump" for this same purpose. Another accessory from that same source "incorporates a small diameter orifice which is provided in fittings for installation into" the downhole pump for preventing gas lock. For various reasons, such attempts to solve these problems are characterized by certain disadvantages and limitations which limit their utility. For instance, the orifice in the accessory provided by National Rod Pumping is susceptible to being plugged by the same particulate matter which causes problems with the valve seats and the cutting of the barrel and/or plunger. In short, there is still a need for a downhole pump which overcomes these limitations, and it is another principal object of the present invention to provide such a pump.

It is another object of the present invention to provide a downhole pump which is anchored in the well intermediate the ends of the barrel of the pump, thereby availing itself of many of the advantages of both top and bottom anchored pumps.

It is another object of the present invention to provide a downhole pump in which fluid flow out of the barrel of the pump continually flushes any particulate matter out of the pump and away from the annulus between pump and tubing.

It is another object of the present invention to provide a downhole pump in which the structure which seals the space between barrel and barrel is not located at the leading edge of the plunger and which is, therefore, less susceptible to the passage of particulate matter into that space, thereby prolonging the service life of the barrel and plunger.

It is another object of the present invention to provide a pump for downhole and surface applications which is relatively inexpensive to manufacture and maintain.

It is another object of the present invention to provide a pump for use in applications in which the fluid being pumped is characterized by a high content of particulate matter which routes the flow of fluid through the space between the plunger and the barrel of the pump and away from locations in which accumulations of particulate matter could cause operational difficulties.

Still another object of the present invention is to provide a pump for downhole and surface applications having an easily replaceable wiper seal for sealing around the plunger thereof.

It is another object of the present invention to provide an apparatus for pumping fluid from a well which produces fluid regardless of the fluid pressure of the well.

It is another object of the present invention to provide an apparatus which is used to advantage in deeper, higher pressure wells than those in which the pump described in my co-pending application Ser. No. 07/518,166 is best utilized.

Other objects, and the advantages of the present invention, will be made clear to those skilled in the art by the following description of a presently preferred embodiment thereof.

SUMMARY OF THE INVENTION

Those objects are achieved by providing a rod actuated pump comprising an elongate, hollow barrel having means intermediate the ends thereof for seating in a tubing anchor to seal the production tubing of a well and having a plurality of ports located in the wall thereof immediately above the seating means for passage of fluid out of the barrel and into the annulus between the barrel and the tubing above the seating means. An elongate plunger having a plurality of ports located in the wall thereof near the top of the plunger for passage of fluid out of the plunger and into the annulus between the plunger and the barrel is reciprocally mounted in the barrel. A standing valve is mounted in the barrel for opening and closing during reciprocation of the plunger to allow and prevent, respectively, the passage of fluid into the barrel from the well. A seal is mounted in the interior wall of the barrel for bearing against the outside surface of the plunger between the standing and traveling valves to prevent migration of fluid into the annulus between the barrel and the plunger, and a traveling valve is mounted in the plunger for opening and closing during reciprocation of the plunger to allow and prevent, respectively, the passage of fluid into the plunger from within the barrel. During the downstroke of the plunger, the fluid in the barrel passing through the traveling valve displaces the fluid in the plunger out of the ports in the wall of the plunger and into the annulus between the plunger and the barrel above the seal, and the displaced fluid in the annulus between the plunger and the barrel above the wiper seal passes through the ports in the barrel to displace fluid in the production tubing above the seating means upwardly in the production tubing.

DETAILED DESCRIPTION OF THE PREFERRED EMBODIMENTS

Figures 1, 4, 5:
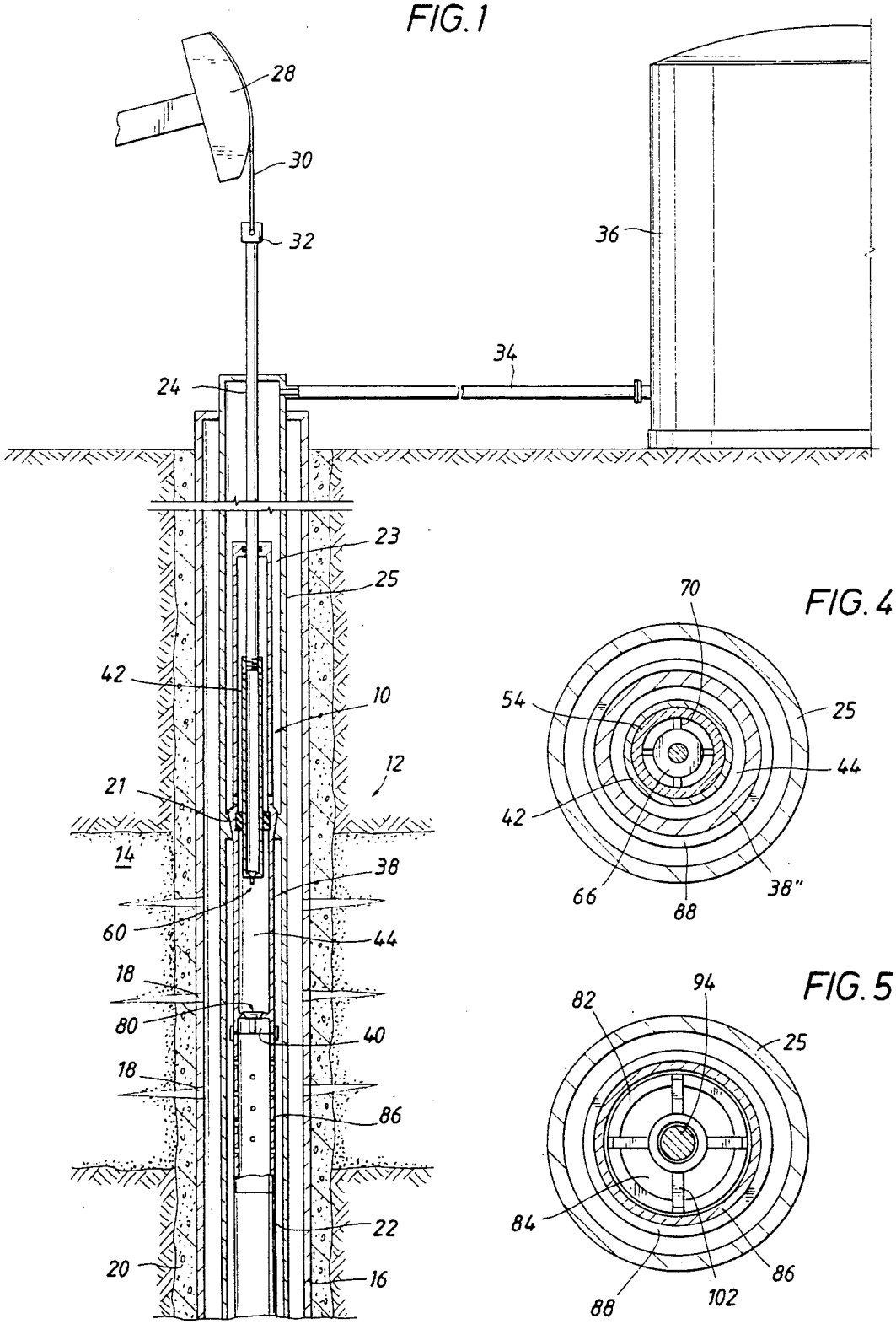
FIG. 1 shows a longitudinal, sectional view through a well having a sucker rod pump constructed in accordance with the present invention installed therein.
FIG. 4 is a cross-sectional view, taken along the lines 4—4 in FIG. 3, of the pump of FIG. 1.
FIG. 5 is also a cross-sectional view of the pump of FIG. 1, taken along the lines 5—5 in FIG. 3.

As described above, one of the uses for a pump constructed in accordance with the present invention is in an oil well and, as noted above, it is relatively deep stripper wells in which such pumps may be used to particular advantage. Such a use is shown in FIG. 1, in which the pump is indicated generally at reference numeral 10. The well is indicated generally at reference numeral 12, and, for purposes of illustration, is shown in a sand formation 14 with a casing 16, perforated at 18 in formation 14, and set in concrete 20. A tubing anchor 21 of conventional construction is run into the well 12 in the string of production tubing 25 above the formation 14 and in a position intermediate the ends of pump 10. Oil and/or gas, both of which are indicated at reference numeral 22, are produced through the annulus 23 between the production tubing 25 and pump 10. The string 24 of sucker rods 26 is reciprocated by a conventional rocking pump 28, attached to the string 24 by a tether 30 and yoke 32 as known in the art, or by a compressed air pump of the type described in my previous U.S. Pat. Nos. 3,643,432, 3,782,247, and 3,986,355. Oil 22 produced from the well 12 passes out of the production tubing 25 into a flexible hose 34 and on into a storage tank 36.

Figure 2:
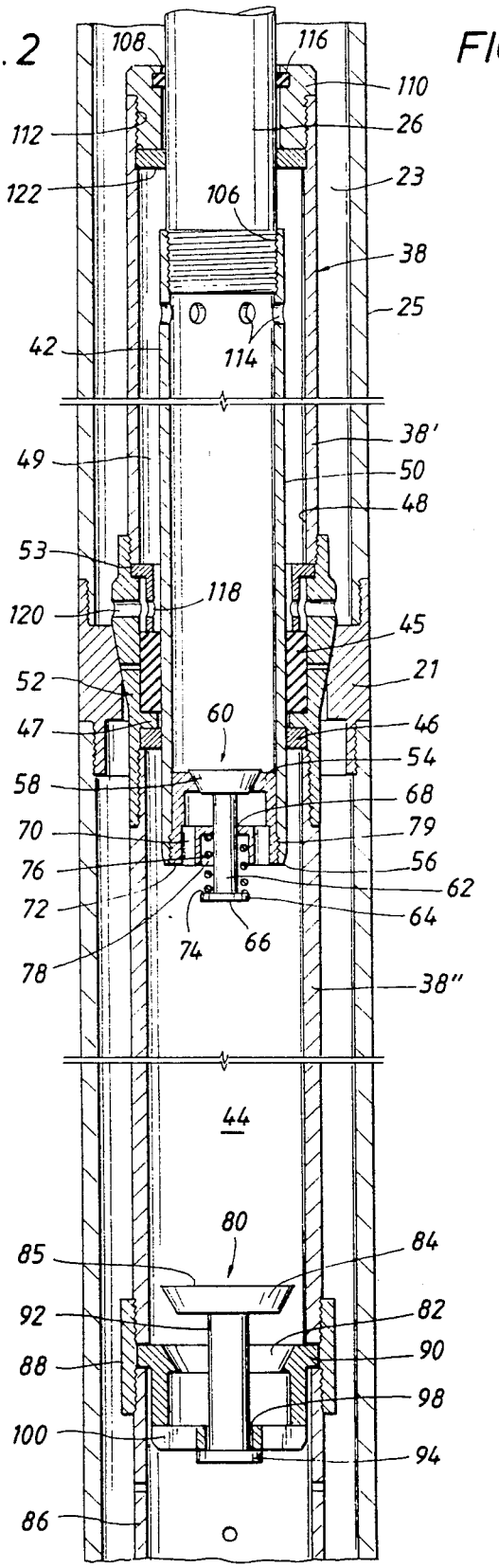
FIG. 2 is an enlarged sectional view of the pump of FIG. 1 showing the plunger of the pump at the completion of the upstroke thereof.
Figure 3:
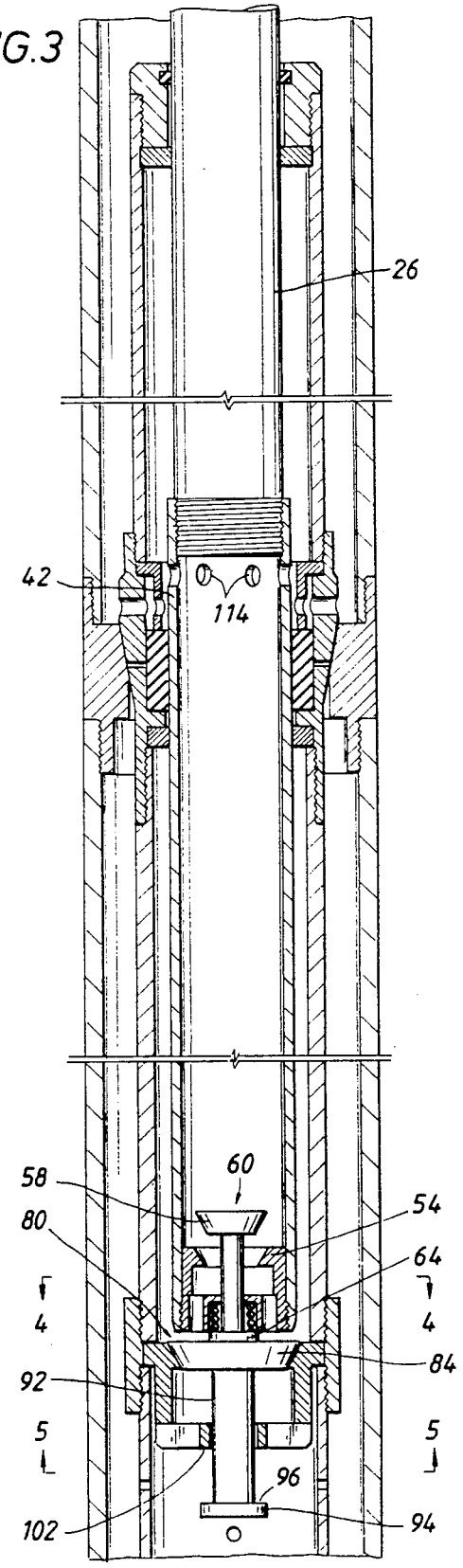
FIG. 3 is a sectional view of the pump of FIG. 2 showing the plunger at the completion of the downstroke.

Referring now to FIGS. 2 and 3, the structure of a pump such as the pump 10 is shown in detail. Pump 10 comprises an elongate, hollow barrel 38, the bottom end 40 of which is submerged in a fluid such as the oil 22 to be pumped (see FIG. 1). An elongate plunger 42 is mounted in the interior 44 of barrel 38 and, for ease in servicing the pump 10, barrel 38 is constructed of upper and lower retainer halves 38' and 38". The retainer halves 38' and 38" are provided with, and are screwed together at, a packing/hold down assembly 52 which comprises means for seating the pump 10 in tubing anchor 21, and which sandwich a packing retainer 53 therebetween. The packing assembly 52 is provided with a lead or other metallic ring (not shown) and is sized, so as to provide a precision, metal-to-metal seal with tubing anchor 21 to prevent the passage of fluid past tubing anchor 21 within production tubing 25.

A plunger packing 45 is mounted or trapped between packing retainer 53 and a shoulder 47 formed in packing assembly 52 for bearing against the outside surface 50 of plunger 42 for retarding migration of the fluid to be pumped into the annulus 49 between the outside surface 50 of plunger 42 and the wall 48 of barrel 38 above traveling valve 60. In an alternative embodiment (not shown), the plunger packing 45 and packing retainer 53 are eliminated altogether and the interior diameter of packing assembly 52 is sized so as to provide a precision, metal-to-metal seal against the outside surface 50 of plunger 42. The alternative embodiment is preferred for use in wells having particularly demanding pressure or other operating requirements, but may be used to advantage in any well. A wiper seal 46 is mounted or trapped in the space between shoulder 47 and the bottom retainer half 38" for wiping particulate matter in the fluid in the interior 44 of barrel 38 below traveling valve 40 off of the outside surface 50 of plunger 42 as plunger 42 reciprocates within the barrel 38. As clearly shown in FIGS. 2 and 3, the clearance between the outside surface 50 of plunger and the wall 48 of barrel 38 is of dimensions such that when sand, scale, or other particulate matter does work past the leading edge, or bottom end, 56 of plunger 42 to enter the space therebetween, the outside surface 50 will not be scored by that particulate matter as plunger 42 reciprocates within the interior 44 of barrel 38.

A valve seat 54 is mounted in plunger 42, preferably near the bottom end 56 thereof, having a valve member 58 seated therein to form a traveling valve 60. The traveling valve member 58 is provided with an elongate stem 62 extending down through the valve seat 54 and having a disc or flange 64 formed on the end thereof such that the stem 62 terminates in a lower bearing surface 66 on the bottom of that flange 64. Stem 62 extends down through an opening 68 formed in a spider 70, the bottom surface 72 of spider 70 and the shoulder 74 formed by the flange 64 on stem 62 comprising means for retaining the traveling valve member 58 in the traveling valve seat 54. Means is also provided for biasing the traveling valve member 58 closed in the form of the spring 76 captured between the shoulder 74 and a bore 78 formed in spider 70 concentric with opening 68 therein. For ease in servicing the pump 10, traveling valve seat 54 and spider 70 are integral such that the entire traveling valve 60 is screwed out of plunger 42 on threads 79.

As indicated generally at reference numeral 80, barrel 38 is provided with a standing valve 80 formed of a standing valve seat 82 having a standing valve member 84 seated therein. For ease in servicing the pump 10, standing valve 80 is mounted between the lower retainer half 38" and a perforated barrel 86, screwed together with collar 88. The flange 90 in standing valve seat 82 extends radially outwardly into the space between the bottom margin of retainer half 38" and the top margin of barrel 86 and is sandwiched therebetween. Standing valve member 84 may be interchangeable with traveling valve member 58 and includes a stem 92 extending down though the standing valve seat 82 and having a disc or flange 94 formed on the end thereof such that the flange 94 forms a shoulder 96. Stem 92 extends down through an opening 98 formed in a spider 100, which may be integral with standing valve seat 82, the bottom surface 102 of spider 100 and the shoulder 96 formed by the flange 94 on stem 92 comprising means for retaining the standing valve member 84 in the standing valve seat 82.

Referring to the figures, the operation of the pump 10 of the present invention will now be described. The oil 22 or other fluid enters the interior 44 of barrel 38 during the upstroke of plunger 42 through standing valve 80 because the pressure in the interior 44 is lower than the pressure of fluid within perforated barrel 86, the traveling valve 60 being closed during the upstroke to relieve the pressure of the weight of the fluid in the production tubing 25. During the downstroke of plunger 42, the fluid within the interior 44 of barrel 38 above standing valve 80 is compressed such that fluid pressure rises until the fluid pressure therein exceeds the weight of the fluid in the production tubing 25 and traveling valve 60 opens to allow fluid therethrough into the interior of plunger 42.

However, when only small quantities of fluid enter the interior 44 of barrel 38 during the upstroke, as is the case when the well 12 is pumped off, or when the fluid passing through standing valve 80 includes a quantity of gas as well as liquid, pressure in the interior 44 of barrel 38 above standing valve 80 may not rise enough during the downstroke to open traveling valve 60. The pump 10 would then be said to be gas locked except for the provision of a method of preventing gas lock which comprises the steps of pumping the oil 22 or other fluid by reciprocating the plunger 42 inside barrel 38 and opening the traveling valve 60 in plunger 42 when plunger 42 is near the maximum extent of downward movement to allow sufficient fluid in the interior of plunger 42 above traveling valve 60 to pass back through traveling valve 60 down into the interior 44 of barrel 38 below traveling valve 60 when fluid pressure therein is lower than the fluid pressure in the interior of plunger 42 above traveling valve 60 to raise the fluid pressure therein above the fluid pressure in the interior of the plunger 42 above traveling valve 60 so that traveling valve 60 will open as a result of that pressure difference.

The opening of traveling valve 60 near the maximum extent of downward travel is accomplished by the contacting of an upper bearing surface 85 located on the valve member 84 of standing valve 80 by lower bearing surface 66 located on the stem 62 of valve member 58 of traveling valve 60 which extends downwardly through the seat 54 of traveling valve 60, causing the valve member 58 to be forced upwardly and opening traveling valve 60. This contact between upper and lower bearing surfaces 85 and 66, respectively, effectively transfers the weight of the fluid in the production tubing 25 exerted against the valve member 58 of traveling valve 60 to the valve member 84 of standing valve 80, having the additional benefit of dislodging any sand, scale, or other particulate matter which might lodge in the opening between either of the respective valve members 84 and 58 and their valve seats 82 and 54. In such situations, the fluid in the interior 44 bears against the valve member 58 of the traveling valve 60 during downward travel of plunger 42 and traveling valve 60 remains closed as a result of the fluid weight. Further, by continuing the downward travel of plunger 42 after contact between bearing surfaces 66 and 85, the traveling valve 60 is forced open against the weight of the fluid in production tubing 25, causing a stream of high pressure fluid to be sprayed over standing valve 80 to dislodge and/or flush any particulate matter out from between valve member 84 and valve seat 82.

Under normal, e.g., non-gas locked, operating conditions, fluid 22 enters the interior 44 of barrel 38 during the upstroke of plunger 42, traveling valve 60 being held closed by the weight of the fluid in production tubing 25, through standing valve 80 as a result of the pressure differential across standing valve 80. Upon reversal of plunger 42, the pressure in the interior 44 of barrel 38 rises until standing valve 80 is forced closed and traveling valve 60 is opened, the fluid in the interior 44 of barrel 38 passing through traveling valve 60 into plunger 42 as a result of that pressure differential. Fluid passing into plunger 42 through traveling valve during the downstroke displaces the fluid already in plunger 42 out of plunger 42 through the ports 114 located in the wall of plunger 42 near the top thereof into the annulus 49 between plunger 42 and barrel 38. At the same time, the fluid accumulated in annulus 49 is displaced out of annulus 49 through the portals 118 in packing retainer 53, on out through the exit ports 120 in packing/hold down assembly 52 into the annulus 23 between barrel 38 and production tubing 25, and then on up the production tubing 25 into tank 36.

An upper packing 122 is set in the seal, or cap, 110 received by the threads 112 formed in the upper end of retainer half 38' and an upper wiper seal 116 is trapped in the groove (not numbered) formed in the wall 48 of retainer half 38' by seal 110. Packing 122 bears against the surface of the pull rod 26 received by the threads 106 formed in the top of plunger 42 to prevent the escape of fluid from the annulus 49 out through the opening 108. As described above, the lower packing 45 bears against the outside surface 50 of plunger 42 to retard the passage of fluid out of the annulus 49 therebetween back down into the well 12.

The flow of fluid through the annulus 49 and out the portals 118 in packing retainer 53 and exit ports 120 of packing assembly 52 immediately above the means formed in packing assembly 52 for seating in tubing anchor 21 prevents the accumulation of sand or other particulate matter between barrel 38 and plunger 42, effectively eliminating concerns relating to the scoring or sticking of plunger 42 as a result of particulate matter caught between plunger 42 and barrel 38. In other words, because particulate matter tends to settle at the bottom of annulus 49 because of the influence of gravity, the routing of the fluid through the portals 118, which are located at the bottom of annulus 49, flushes any accumulated particulate matter out of the annulus 49 on each downstroke of plunger 42. For the same reason, the location of the exit portals 120 in packing-/hold down assembly 52 at the bottom of the annulus 23 between barrel 38 and production tubing 25, and the flow of fluid through exit portals 120 on each downstroke of plunger 42, prevents the accumulation of particulate matter in the annulus 23 immediately above tubing anchor 21. As noted above, and even assuming that the best known prior art traveling valve plunger is optimally spaced for prevention of accumulation of particulate matter (which may or may not be optimal for other operating conditions in a well), the designs of such prior pumps are such that a build-up of sand or other particulates can accumulate around the outside of the plunger immediately above the hold-down That accumulation is sufficient to have the almost inevitable result that, sooner or later, some of the accumulated particulate matter works into the space between the outside surface of the plunger and the inside surface of the barrel to cause scoring of the plunger and even sticking. Consequently, by the use of the phrase "immediately above" throughout the present specification in describing the location of the exit ports 120 relative to tubing anchor 21, it is intended to describe a location relative to the tubing anchor 21 which is such as to cause a flow of fluid away from the plunger 42 in such a manner as to flush or otherwise prevent the accumulation of particulate matter at a location which will eventually result in the infiltration of that particulate matter into the space between the outside surface 50 of plunger 42 and the inside surface 48 of barrel 38. In the presently preferred embodiment shown in FIG. 1, that function is accomplished by locating the exit ports 120 in the packing/hold down assembly 52 which forms a part of the wall of barrel 38; the same function could also be accomplished by locating the ports in the wall of the barrel itself just above the tubing anchor 21, e.g., within an inch or so of tubing anchor 21, in the packing assembly 52 in a location which is in fluid communication with a passageway in the tubing anchor 21, or in other locations which will be known to those skilled in the art who have the benefit of this disclosure.

Another advantage of the pump 10 of the present invention, made possible by the location of the ports 114 near the top of plunger 42 and the location of the portals 118 and exit ports 120 immediately above tubing anchor 21, e.g., near the leading edge of plunger 42 when plunger 42 is near the top of the stroke, is that fluid is moved through both the portals 118 and the exit ports 120 during both the upstroke and downstroke of plunger 42. In other words, as described above, fluid is displaced up the production tubing 25 as a result of the filling of the plunger 42 during the downstroke thereof. During the upstroke of plunger 42, the volume of the annulus 49 between plunger 42 and barrel 38 is decreased as a result of the larger outside diameter of plunger 42 as compared to the outside diameter of pull rod 26 and the sealing of the annulus 49 by wiper seals 46 and 122. That decrease in volume raises the pressure of the fluid residing in the annulus 49 to a point at which the fluid escapes through ports 120 during the upstroke of plunger 42, thereby flushing the portals 118 and ports 120 even during the upstroke. With that capability, as well as the ability to force open the standing valve 80 and/or spray fluid thereon near the bottom of the stroke of plunger 42, the pump 10 of the present invention is virtually immune to the usual difficulties created by sandy wells.

Although the invention has been described in terms of a presently preferred embodiment, those skilled in the art who have the benefit of this disclosure will recognize that certain changes can be made to the structure thereof without changing the manner in which that structure functions to achieve the specified results. For instance, instead of a downwardly extending stem 62 terminating in a lower bearing surface 66, the lower bearing surface 66 can take the form of a flat bottom on traveling valve member 58 and standing valve member can be provided with an upwardly extending stem (not shown) having the upper bearing surface 85 located thereon. All such changes in structure functions to accomplish the result intended for that structure are intended to fall within the spirit and scope of the following claims.

What is claimed is:

1. A rod actuated pump for pumping fluid up through the production tubing out of a well comprising;

an elongate, hollow barrel having means intermediate the ends thereof for seating in a tubing anchor to seal the production tubing of a well and anchor said barrel in the well having a plurality of ports located in the wall thereof immediately above said seating means for passage of fluid out of said barrel and into an annulus between said barrel and the tubing above the seating means;

an elongate, hollow plunger having a plurality of ports located in the wall thereof near the top of said plunger reciprocally mounted in said barrel in a position in which the ports do not reciprocate below said seating means;

a standing valve mounted in said barrel for opening and closing during reciprocation of said plunger therein to allow and prevent, respectively, the passage of fluid into said barrel from the well;

a seal mounted in said barrel to retard the migration of fluid along said plunger out of the annulus between said plunger and said barrel; and a traveling valve mounted in said plunger for opening and closing during reciprocation of said plunger in said barrel to allow and prevent, respectively, the passage of fluid into said plunger from within said barrel, the fluid in said barrel passing through said traveling valve displacing the fluid in said plunger out the ports in the wall of said plunger and into the annulus between said plunger and said barrel above said seal, and the displaced fluid in the annulus between said plunger and said barrel above said seal passing through the ports in said barrel to displace the fluid in the production tubing above said seating means upwardly in the production tubing.

2. The pump of claim 1 wherein said plunger is reciprocated by a pull rod extending through the top of said barrel to which said plunger is mounted, the diameter of said pull rod being smaller than the diameter of said plunger whereby fluid is displaced from the annulus between said barrel and said plunger through the ports in said barrel during reciprocation of said plunger when said traveling valve is closed.

3. The pump of claim 1 wherein said traveling valve is provided with a valve member having an elongate stem extending down through said valve and terminating in a lower bearing surface and said standing valve is provided with a valve member having an upper bearing surface for engagement by the lower bearing surface of the valve member of said traveling valve when said plunger nears the maximum extent of downward movement to force the traveling valve open if the fluid pressure above said traveling valve is higher than the fluid pressure below said traveling valve to force said standing valve closed if said standing valve is stuck in the open position.

4. The pump of claim 1 wherein said barrel is comprised of upper and lower retainer halves, said seating and sealing means forming the portion of the barrel located therebetween.

5. The pump of claim 4 wherein the ports in said barrel are located in said seating and sealing means.

* * * * *